United States Patent [19]

Nakashima

[11] Patent Number: 5,042,410

[45] Date of Patent: Aug. 27, 1991

[54] PROFILE SEWING MACHINE CAPABLE OF PROJECTING STITCHING REFERENCE IMAGE IN ACCORDANCE WITH PROFILE OF WORKPIECE EDGELINE

[75] Inventor: Akifumi Nakashima, Ichinomiya, Japan

[73] Assignee: Brother Kogyo Kabushiki Kaisha, Aichi, Japan

[21] Appl. No.: 657,863

[22] Filed: Feb. 20, 1991

[30] Foreign Application Priority Data

Mar. 2, 1990 [JP] Japan ..... 2-52399

[51] Int. Cl.[5] ..... D05B 3/02

[52] U.S. Cl. ..... 112/445; 112/453; 112/153; 112/306

[58] Field of Search ..... 112/453, 456, 153, 306, 112/445, 121.11, 121.12

[56] References Cited

U.S. PATENT DOCUMENTS

| | | | |
|---|---|---|---|
| 4,248,168 | 2/1981 | Hoffman | 112/153 X |
| 4,270,473 | 6/1981 | Brienza | 112/445 |
| 4,664,048 | 5/1987 | Naganuma et al. | 112/453 |
| 4,823,716 | 4/1989 | Nakashima | 112/453 |
| 4,827,858 | 5/1989 | Horie et al. | 112/153 X |
| 4,869,189 | 9/1989 | Horie et al. | 112/453 |
| 4,966,090 | 10/1990 | Tanaka et al. | 112/456 |
| 5,000,105 | 3/1991 | Tanaka | 112/453 |

FOREIGN PATENT DOCUMENTS

| | | | |
|---|---|---|---|
| 62-68483 | 3/1987 | Japan . | |
| 64-45865 | 2/1989 | Japan | 112/121.11 |
| 1-115469 | 8/1989 | Japan . | |

*Primary Examiner*—Peter Nerbun
*Attorney, Agent, or Firm*—Oliff & Berridge

[57] ABSTRACT

A sewing machine capable of performing a profile sewing in which a stitch is provided at a position spaced away from an edgeline of a workpiece by a predetermined constant distance to provide a predetermined margin. The sewing machine is provided with memory means which stores therein the needle position data. This data is transmitted to a sewing needle swinging mechanism so as to move the sewing needle to a position inwardly spaced away from the edgeline to provide the margin. The sewing machine is also provided with image forming means connected to the memory means for providing a visualized image of a stitching reference line on one of a surface of the bed and the workpiece fabric on the bed in accordance with the needle position data. The stitching reference serves as a guide line along which the edgeline is placed.

8 Claims, 8 Drawing Sheets

PROFILE SEWING MACHINE CAPABLE OF PROJECTING STITCHING REFERENCE IMAGE IN ACCORDANCE WITH PROFILE OF WORKPIECE EDGELINE

BACKGROUND OF THE INVENTION

The present invention relates to a profile sewing machine for profile stitching to a workpiece in parallelism with an edgeline thereof. More particularly, the invention relates to such profile sewing machine in which a stitching reference line can be visualized on a bed or the workpiece on the bed by a projector etc., the reference line serving as a guide line for sewing a predetermined inward position of the workpiece in parallelism with the edgeline of the workpiece.

Profile sewing has been conventionally carried out in which swing needle location is positioned at a predetermined inward position of the workpiece fabric relative to the edgeline thereof, so that a seam or stitching line is oriented in parallel with the edgeline. For facilitating the profile sewing, one conventional profile sewing machine has been proposed in which the sewing needle can be automatically moved laterally at the predetermined inward position of the workpiece fabric in such a manner that the needle location is automatically changed to maintain parallelism with the edgeline of the workpiece fabric in accordance with a result of detection to a position of the edgeline.

Such profile sewing machine is described in, for example, Japanese Patent Application Kokai No. 62-68483. The profile sewing machine includes a needle bar, a needle bar swinging mechanism, a workpiece fabric detector and control means. The needle bar has a lower end securing a sewing needle, and is movable in a vertical direction as well as a lateral direction with respect to feeding direction of the workpiece fabric. The needle bar swinging mechanism is adapted for swinging the needle bar in the lateral direction within a predetermined stroke range. The workpiece fabric detector is adapted to detect the edgeline of the workpiece fabric. And the control means is adapted for controlling the movement of the needle bar swinging mechanism in order to provide a needle location at a proper inward distance from the workpiece edgeline.

With the structure, the sewing needle can follow the workpiece fabric in the lateral direction even if the latter is laterally deviated during the profile sewing operation. Therefore, maintainable is a constant distance between the workpiece edgeline and the needle location, to thereby provide a constant or uniform stitch margin (the distance between the edgeline and the exact needle location or exact stitched line will be referred hereinafter as the term "margin").

Further, prior to the profile sewing, the sewing needle can be automatically moved toward the seam or stitching position when the workpiece fabric is mounted on the bed. However, in such conventional sewing machine, if the deviation of the workpiece fabric exceeds a predetermined level during the profile sewing, the sewing needle cannot follow the deviation, to thereby render the automatic profile sewing inoperative. In such case, the sewing operation is temporarily suspended or the sewing speed is lowered, and then, the workpiece fabric is manually moved so as to correct the lateral position of the sewing needle or the needle location in response to the lateral movement of the workpiece. When correction work is carried out for correcting the position of the workpiece fabric, it would be rather difficult for an operator to make judgment as to the laterally deviating direction of the sewing needle. As a result, a long time period may be required for the positional correction.

Then, improvement is made on such conventional profile sewing machine in an invention disclosed in Japanese Patent Application Kokai No. 1-115469. The improved sewing machine is provided with instruction means for instructing direction in which the sewing needle is to be moved in order to correct the deviation or for instructing the deviating direction of the sewing needle. The improved sewing machine includes, in addition to the mechanical and electrical components equipped in the conventional sewing machine described in the above described JP 62-68483, a detection means and the instruction means. The detection means detects the deviating direction of the sewing needle with respect to a center position of a swingable range of the needle, and the instruction means instructs the deviating direction of the sewing needle or correcting direction of the needle in accordance with a result of the detection by the detection means. The instruction means includes a plurality of display lamps arranged on a main body of the sewing machine, which lamps indicate the deviating direction or deviation-correcting direction. Further, a front ruler is conventionally used for guiding travel of the workpiece fabric so as to obtain uniform stitching margin, and the ruler is also available in the profile sewing machine.

However, when correcting the needle location in accordance with the deviation of the workpiece fabric during profile sewing operation, the improved sewing machine still has a problem in that it would be difficult for an operator to make judgment as to a proper correcting position from the deviated position. In the sewing machine described in the above described JP 1-115469, since the deviating direction and the deviation-correcting direction are displayed by the lamps arranged on the main body, the operator, who draws her particular attention to the sewing needle and the workpiece edge, must also turn her eyes upon these lamps in sewing operation in order to note the deviating direction and the deviation correcting direction.

Further, in the method using the front ruler, the ruler must be provided at a precise position, otherwise sufficient profile sewing cannot be attained. Particularly, if the workpiece has a continuous curving edgeline, it would be extremely difficult to determine the suitable setting position of the ruler.

For the purpose of information, a commonly assigned U.S. patent application Ser. No. 07/602,699 has been filed on Oct. 24, 1990. Further, sewing machines of relevant field have been described in U.S. Pat. Nos. 4,248,168, 4,664,048, 4,823,716, 4,827,858 and 4,869,189.

SUMMARY OF THE INVENTION

It is therefore, an object of the present invention to overcome the above-described drawbacks and to provide an improved profile sewing machine in which correction to a position of the workpiece can be easily achieved without turning operator's eye upon a location other than the exact stitching position even during the profile sewing operation.

This and other object of the invention will be attained by providing a visualized projection image indicative of a reference stitching line on a bed or on a workpiece fabric thereon, which reference stitching line serves as a guide line for sewing a predetermined inward position of the workpiece fabric in parallelism with the edgeline thereof, to thereby obtain a constant stitching margin.

That is, according to the present invention, there is provided a sewing machine including a bed, a sewing needle vertically reciprocable for stitching to a workpiece fabric at a position inward from an edgeline and in parallelism therewith to provide a margin, sewing needle swinging mechanism for swinging the sewing needle within a maximum swingable range in a direction across a feeding direction of the workpiece fabric, the swingable range defining a swingable center between one and another swinging end stroke positions, sewing margin setting means for setting the margin, and detection means for detecting the edgeline of the workpiece fabric, and the improvement comprises control means connected to the sewing needle swinging mechanism, the sewing margin setting means and the detection means, the control means comprising means for computing needle position data on a basis of first data indicative of the edgeline position sent from the detector and second data provided by the sewing margin setting means, and memory means which stores therein the needle position data, the needle position data being transmitted to the sewing needle swinging mechanism so as to move the sewing needle to a position inwardly spaced away from the edgeline to provide the margin, and image forming means connected to the control means for providing a visualized image of a stitching reference line on one of a surface of the bed and the workpiece fabric on the bed in accordance with the needle position data, the stitching reference serving as a guide line along which the edgeline is placed.

For the profile sewing, the workpiece fabric can be set on a proper position on the bed with reference to the stitching reference line visually projected on the surface of the bed. Further, during the profile sewing operation, if the workpiece fabric is displaced from its proper position, the position of the workpiece fabric can be easily correctable with reference to the stitching reference line provided on the bed or on the workpiece fabric. During the sewing, the operator gazes at the sewing needle and the edgeline of the workpiece fabric. In this case, the operator can also recognize the reference stitching line, since the line is also directly projected on the workpiece fabric or on the bed positioned immediately adjacent the sewing needle. Therefore, the operator simply looks at this position without turning his or her eyes upon another portion.

DETAILED DESCRIPTION OF THE PREFERRED EMBODIMENTS

Described will be a profile sewing machine capable of projecting a visible projection image indicative of a guide line for stitching along a workpiece edgeline with a predetermined distance therefrom according to one embodiment of the present invention with reference to accompanying drawings. The described embodiment pertains to a profile sewing machine in which a sewing needle is automatically moved to a needle location at a position inwardly of the workpiece edgeline in accordance with a result of detecting the edgeline position of the workpiece fabric. However, the embodiment will also be available for an ordinary sewing machine wherein no fabric edge detection means is provided.

FUNDAMENTAL CONSTRUCTION OF THE SEWING MACHINE

Figure 1:
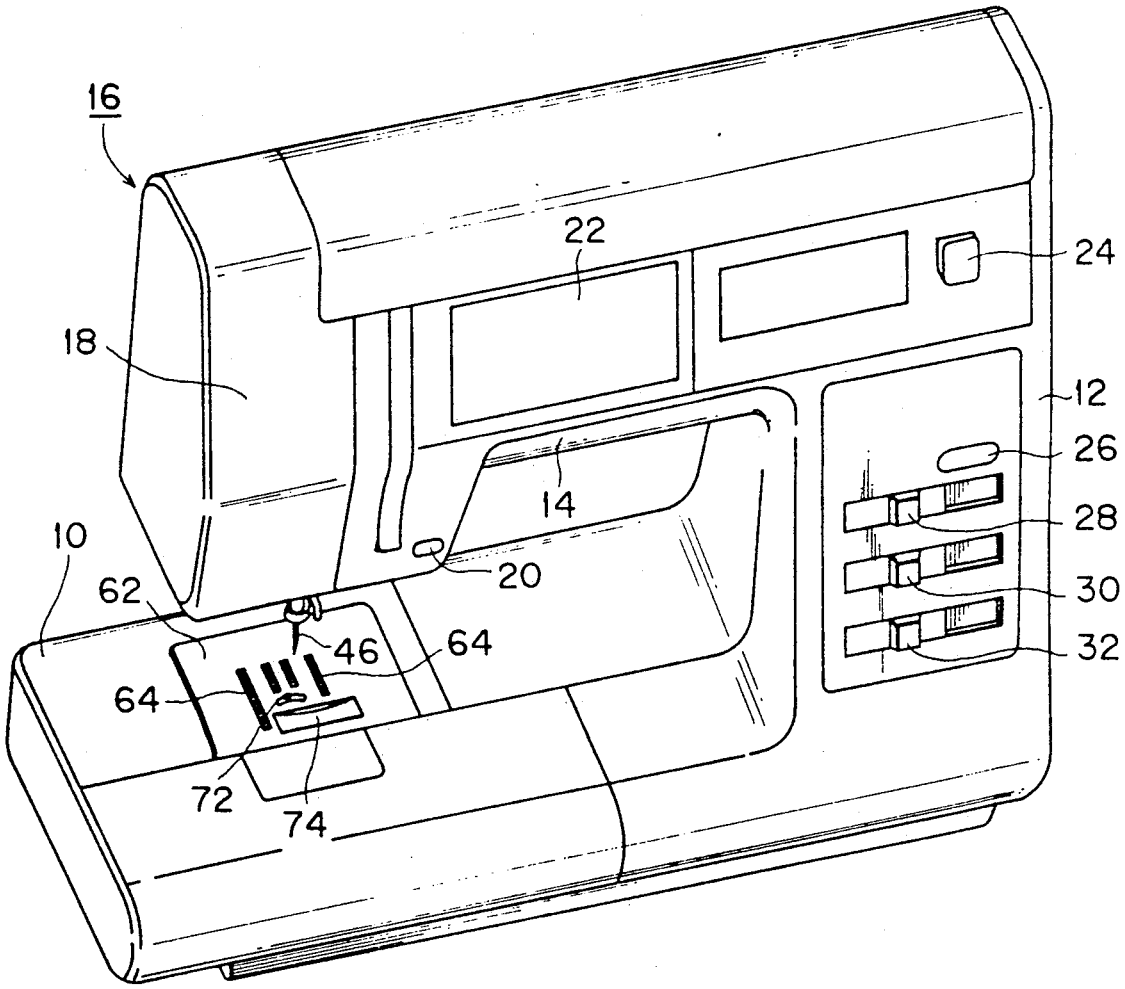
FIG. 1 is a perspective view showing an external arrangement of a profile sewing machine according to one embodiment of the present invention.

In FIG. 1, a profile sewing machine is illustrated. The machine has a machine frame 16 provided with a bed 10, an upstanding support 12 and an upper arm 14. The bed 10 is of flat configuration and is provided with a throat plate 62. The upstanding support 12 extends from one side of the bed 10, and the upper arm 14 horizontally extends from the upstanding support 12 in substantially parallel with the bed 10. In the upper arm 14, a pattern indicating board 22 is attached in which various stitching patterns are illustrated those being stitchable by the sewing machine. Further, a selection switch 24 is also provided in the upper arm 14 so as to select one of the intended stitching patterns. The upper arm 14 has a head 18 at which an energization switch 20 is provided so as to control energization and deenergization of a sewing machine motor 48 shown in FIG. 4.

The upstanding support 12 is provided with a profile sewing switch 26 manipulated for the profile sewing, a sewing margin setting means 28 for setting intended sewing margin, a control means 30 for controlling swingable range of the sewing needle, and a feed amount control means 32. Incidentally, the profile sewing is made along a linear stitching in the case of the profile sewing machine. Accordingly, the control means 30 and 32 are manipulated if a pattern sewing other than the linear stitching is to be performed so as to control needle swinging amount and feed amount.

Figure 2:
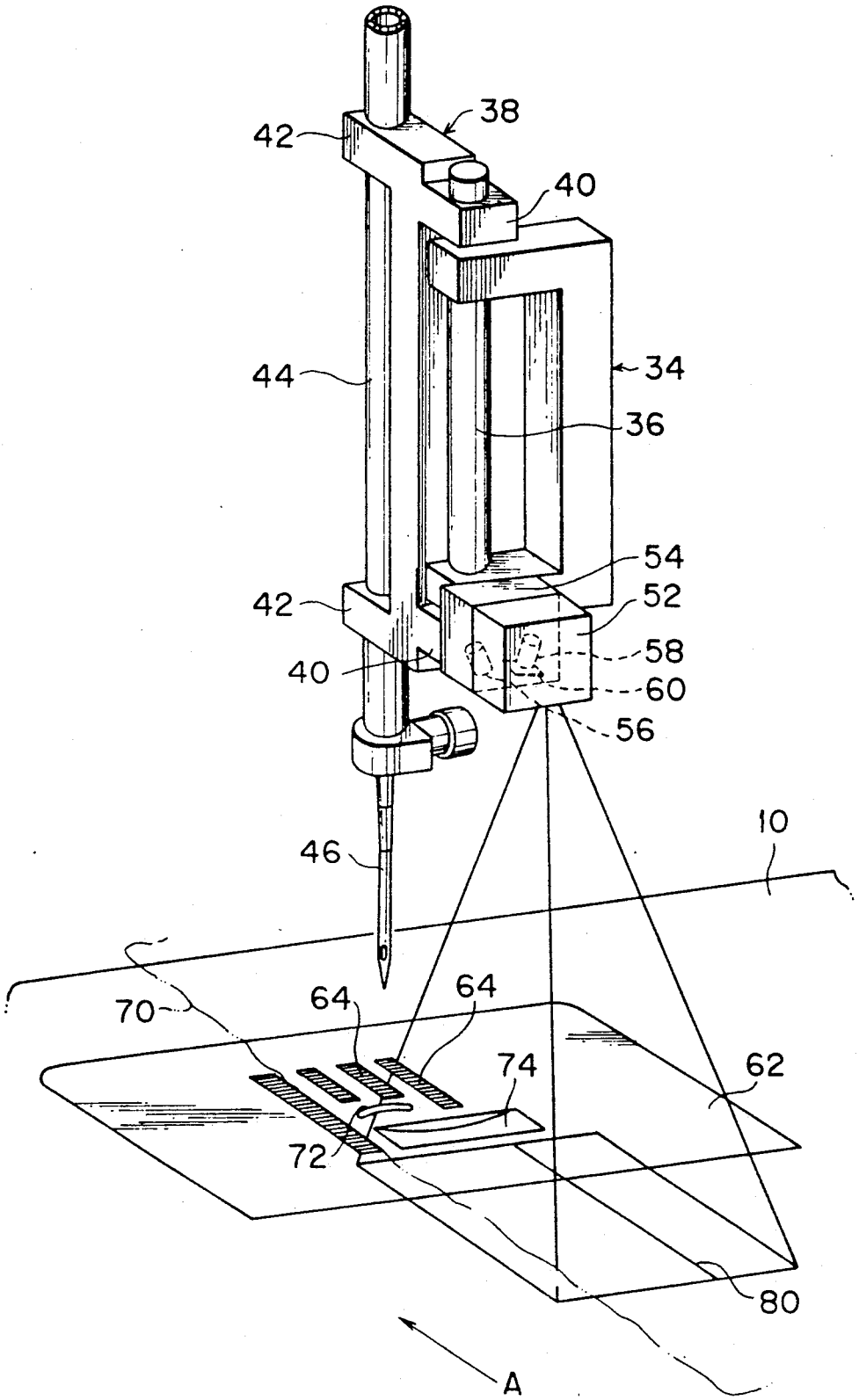
FIG. 2 is a schematic perspective view showing a needle bar and ambient components according to one embodiment of this invention.

As shown in FIG. 2, within the interior of the head portion 18, a U-shaped bracket 34 is stationarily fixed, and a needle bar support frame 38 is pivotally supported to the bracket 34 through a vertical rod 36. That is, the needle bar support frame 38 is pivotable about an axis of the vertical rod 36. More specifically, the needle bar support frame 38 includes a first pair of arms 40, 40 extending in one direction and coupled to the vertical rod 36, and a second pair of arms 42, 42 for slidably supporting a needle bar 44 whose lower end is provided with a sewing needle 46. The needle bar 44 vertically extends through the second pair of arms 42 and 42 and is vertically movable relative to the second pair of arms 42, 42. The needle bar 44 is coupled to the sewing machine motor 48 through a link mechanism (not shown), and is reciprocally movable by the rotation of the motor 48.

The needle bar support frame 38 is connected to a needle swing control motor 50 (FIG. 4) through a link mechanism (not shown). By the rotation of the motor 50, the needle bar support frame 38 is pivotably movable about the axis of the vertical rod 36, so that the sewing needle 46 is movable on the bed along an arcuate locus whose center is coincident with the axis of the vertical rod 36, the locus being substantially transverse with respect to the running direction of the workpiece fabric. The swingable range or stroke of the sewing needle 46 is about 7 mm in the illustrated embodiment.

WORKPIECE FABRIC DETECTOR 54

At a lower portion of the bracket 34, a workpiece fabric detector 54 is provided. The detector 54 includes a light emitting element 56 which emits infrared rays having predetermined wavelength range, and a light receiving element 58 for receiving the infrared rays emitted from the light emitting element 56 and reflected from a reflection surface 74. The detector 54 also includes an optical filter 60 to permit only the infrared rays having the predetermined wavelength range to pass therethrough. The filter 60 is positioned in the vicinity of the light receiving element 58. The detector 54 further includes a signal processing circuit (not shown). The infrared rays emitted from the light emitting element 56 is reflected on the reflection surface 74 and the reflected light is received in the light receiving element 58, to thereby detect a position of the edgeline of the workpiece fabric 70.

Figure 4:
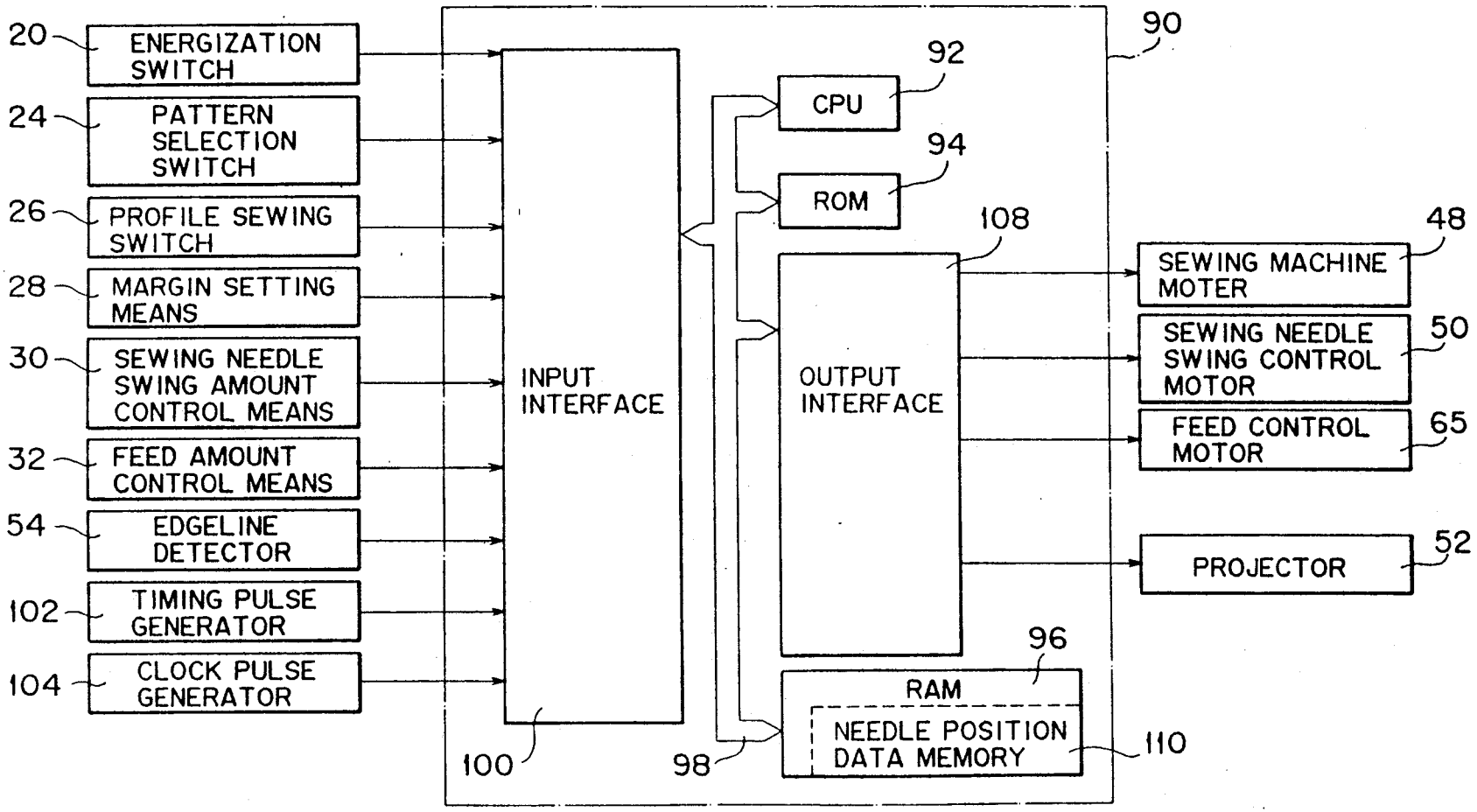
FIG. 4 is a block diagram showing control circuit including a control means for controlling operation of the sewing machine according to the embodiment of this invention.

As shown in FIG. 2, on an upper surface of the bed 10, a throat plate 62 is openably and closeably provided, and a plurality of slots are formed in the throat plate 62. Further, feed dogs 64 are upwardly protrudably provided in the corresponding slots. These feed dogs 64 are connected to the sewing machine motor 48 by means of a link mechanism (not shown), so that the workpiece fabric feeding motions are performed in timed relation to the vertically reciprocating motion of the sewing needle 46 in conjunction with a pressure foot (not shown). Further, as shown in FIG. 4, these feed dogs 64 are connected to a feed control motor 65, and therefore, these feed dogs undergo controlled workpiece fabric feeding. As shown in FIG. 2, the workpiece fabric is fed in a direction indicated by an arrow A. Thus, the feed dogs 64 and the pressure foot perform controlled workpiece fabric feeding operation for feeding the workpiece fabric 70 on the bed in a frontward and rearward directions with respect to an operator.

Figure 6:
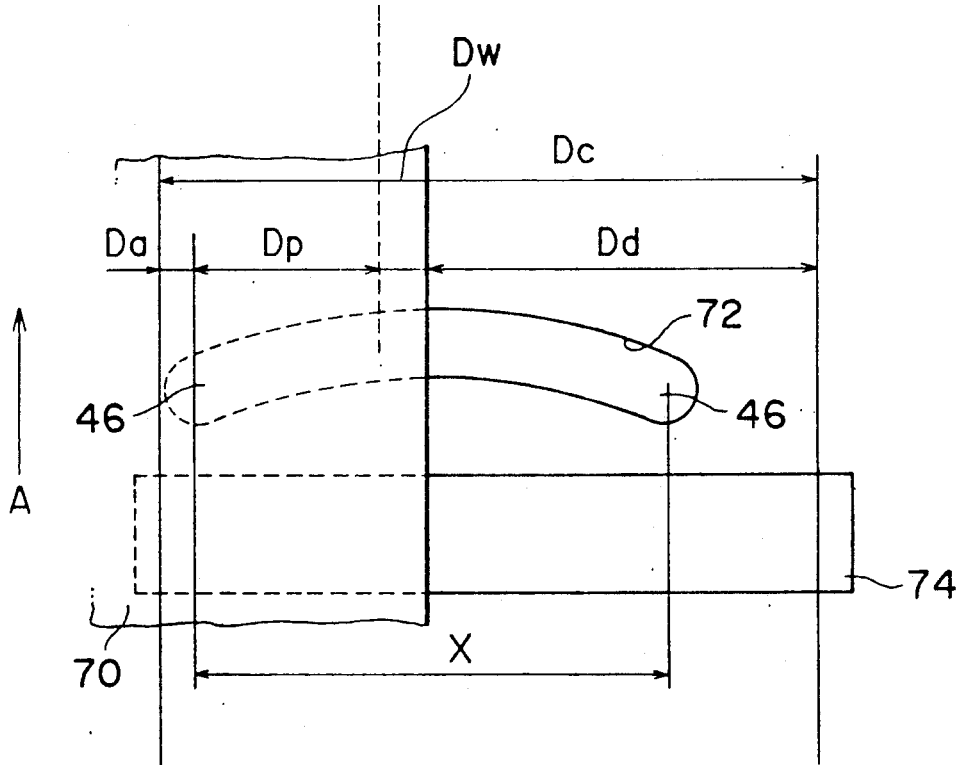
FIG. 6 is a view for description of position detection to a sewing needle according to one embodiment of this invention.

As shown in FIGS. 2 and 6, the throat plate 62 is formed with an arcuate needle slot 72 at a position in conformance with the arcuate moving locus of the sewing needle 46, the arcuate locus being given by the swinging motion of the needle bar support frame 38. Further, along the arcuate needle slot 72 and at a position adjacent thereto, the above described reflection surface 74 is provided on the throat plate 62. The reflection surface 74 extends in the transverse direction of the running direction of the workpiece fabric 70. The reflection surface 74 is of an arcuate recess whose radius center is positioned at a central point between the light emitting element 56 and the light receiving element 58. The infrared rays emitted from the light emitting element 56 is reflected at the arcuate surface, and is directed toward the light receiving element 58.

PROJECTOR

Figure 3:
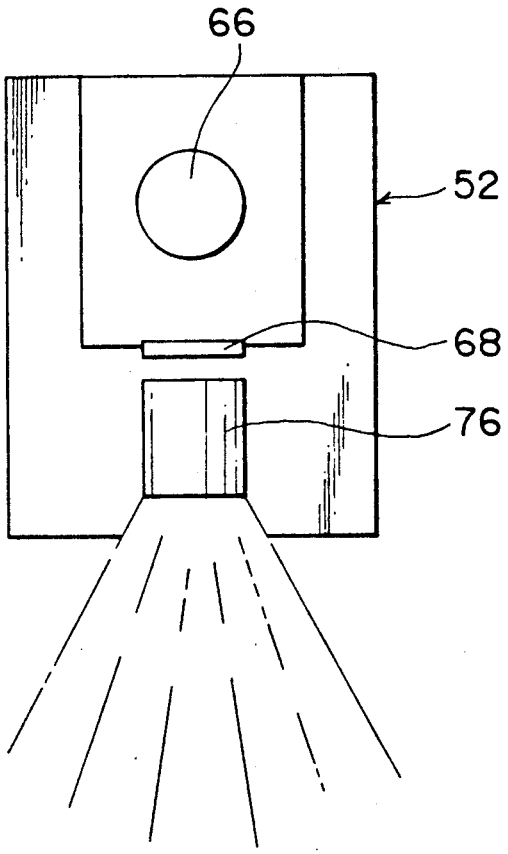
FIG. 3 is a schematic illustration showing a projector used in the embodiment of this invention.

A projector 52 is provided on the fabric edge detector 54 provided at the lower portion of the bracket 34. The projector 52 is adapted for projecting, on the surface of the bed 10 or on the workpiece fabric 70 on the bed 10, a visualized image of a stitching reference line or a guide line at a position indicating the edgeline positioned upstream of the sewing needle with respect to the feeding direction A. The projector 52 fundamentally includes a light source 66, a liquid crystal panel 68 and a focusing lens 76 as shown in FIG. 3. The light source 66 is provided by a discharge lamp of a metal halides type. The liquid crystal panel 68 is adapted to visualize the inward stitching reference in profiling with the edgeline of the workpiece fabric in accordance with data of the sewing needle position read from a memory of a RAM 96 (described later and shown in FIG. 4). The focusing lens 76 is adapted to optically providing the visualized image of the stitching reference by making use of the light transmitted through the liquid crystal panel 68. In the liquid crystal panel 68, a plurality of minute size of shutters (not shown) are arranged. These shutters are openably and closably provided by a drive circuit (not shown) so as to provide the visible image of the stitching reference.

Therefore, by transmitting the light from the light source 66 through the liquid crystal panel 68 and the focusing lens 76, the visualized stitching reference is projected on the surface of the bed 10, or the workpiece fabric 70 on the bed 10 those being positioned at a focal point of the focusing lens 76. Incidentally, instead of the liquid crystal panel 68, a laser beam and a slide film are also available for forming the stitching reference.

ELECTRICAL CONTROL CIRCUIT ARRANGEMENT

An electrical control circuit arrangement for controlling various components and segments in the profile sewing machine of this embodiment is shown in FIG. 4. The control arrangement includes a control unit primarily including a computer 90 for controlling the sewing machine. The computer 90 includes a central processing unit (CPU) 92. The ROM 94 as a memory means, and a readable and rewritable RAM 96, those being connected to one another by a bus 98. The bus 98 is connected, through an input interface 100, the above described sewing machine energization switch 20, the stitch pattern selection switch 24, the profile sewing switch 26, the sewing margin setting means 28, the control means 30 for controlling the swingable range of the sewing needle, the feed amount control means 32, and the fabric edge detector 54. The bus 98 is also connected, through the interface 100, a timing pulse generator 102, and a clock pulse generator 104. Details of the pulse generators 102 and 104 are described in JP 62-68483, and therefore, further description is negligible.

The bus 98 is connected, through an output interface 108, the above described sewing machine motor 48, the needle swing control motor 50, the feed control motor 65 and the projector 52. In the RAM 96, a needle position data memory 110 is provided, in which stored are data of the needle position at a predetermined distance from the edgeline of the workpiece fabric 70 and extending in parallelism with the edgeline or in profiling therewith at a position inward of the edgeline. Further, in the ROM 94, sewing machine control program is stored which program contains the sewing needle swinging control routine shown in a flowchart of FIG. 5. In accordance with the program, the CPU 92 controls the motors 48, 50, 65 and the projector 52.

CONTROL ROUTINE IN PROFILE SEWING OPERATION

Figure 5:
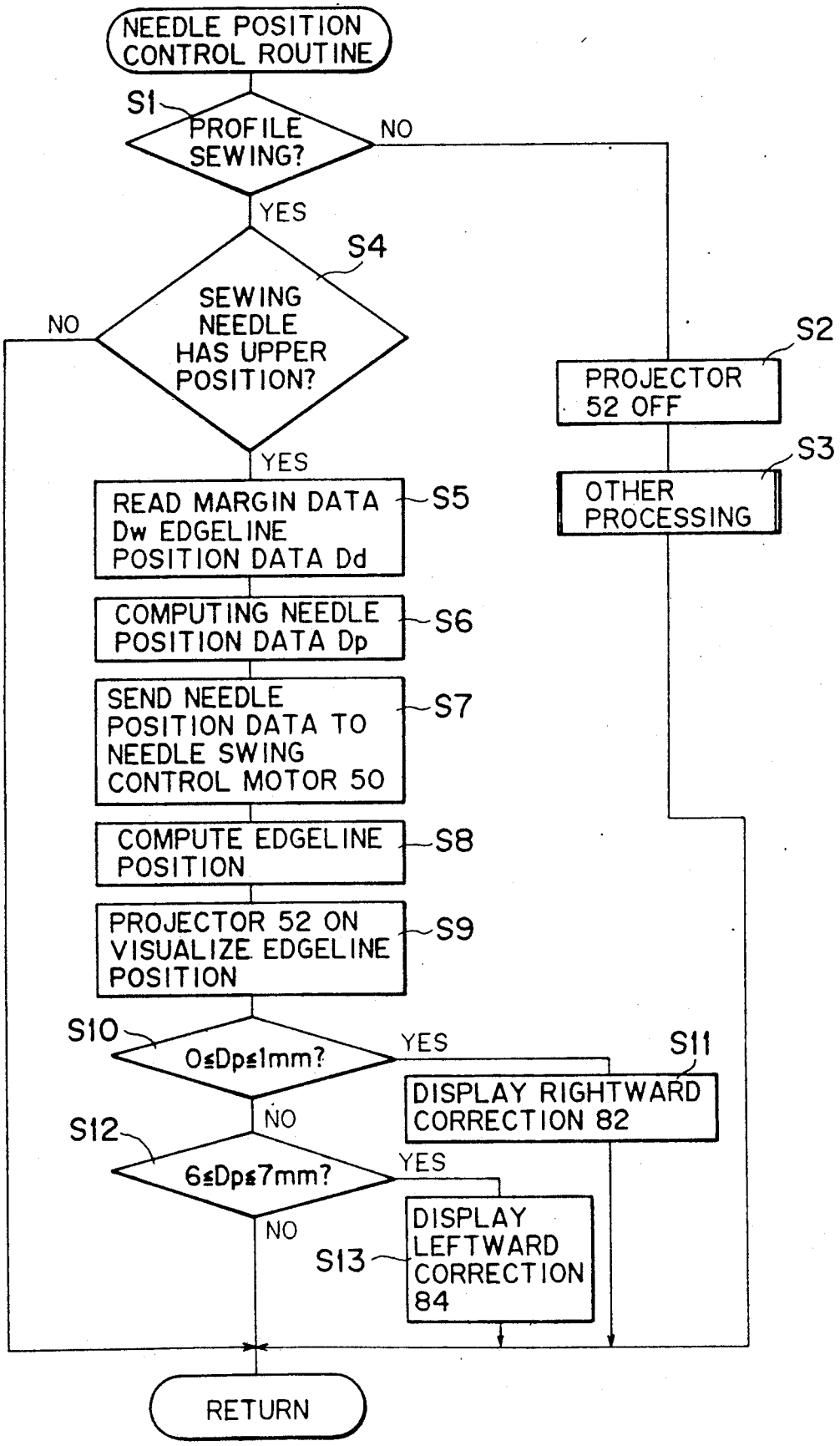
FIG. 5 is a flowchart for description of sequential process governed by a program stored in a ROM of a computer of the control means according to one embodiment of this invention.

Next, the profile sewing operation, particularly the sewing needle position control routine for the profile sewing in accordance with the above described embodiment will be described with reference to the flowchart shown in FIG. 5. In Step S1, judgment is made as to whether or not an intended sewing operation is the profile sewing. This judgment is made in accordance with a signal from the profile sewing switch 26 manipulated by the operator. To be more specific, if the sewing operation other than the profile sewing is intended, the profile sewing switch 26 is rendered OFF, so that the judgment falls NO to proceed into Step S2, to thereby render the projector 52 OFF. Then, the routine proceeds into Step S3 where executed is the sewing operation other than the profile sewing such as pattern stitching.

On the other hand, if the profile sewing operation is selected by the manipulation to the profile sewing switch 26, the judgment in Step S1 falls YES to proceed into Step S4. In Step S4, judgment is made as to whether or not the sewing needle 46 is positioned above he bed 10. This Step S4 is required, since the sewing needle 46 must be disengaged from the workpiece fabric 70 in order to laterally shift the position of the sewing needle 46 for the control to the profile sewing. If the sewing needle 46 is positioned above the bed 10, sewing needle position data Dp (FIG. 6) is computed, and the sewing needle 46 is laterally shifted. The judgment in Step S4 is made by the generation of the pulse generated from the timing pulse generator 102 or the clock pulse generator 104.

If the profile sewing has not yet been started, the judgment in Step S4 falls YES as far as the clock pulse generator 104 generates the clock pulse. On the other hand, if the profile sewing has already been started, the judgment in Step S4 falls YES as far as the timing pulse generator 102 generates the timing pulse. Then, the routine proceeds into Step S5 where read are workpiece fabric edgeline position data Dd (FIG. 6) and the stitching margin data Dw (FIG. 6). If neither the clock pulse nor the timing pulse are generated , the judgment in Step S4 falls NO, and the routine goes back to a main routine.

Incidentally, the timing pulse generator 102 generates the timing pulse TP only when the sewing machine motor is energized. In response to every reciprocating motion of the sewing needle 46, one timing pulse signal is generated. Each time the timing pulse is supplied, the feed data and the needle swing data are supplied to the CPU 92.

As best shown in FIG. 6, the edgeline detector 54 has a lateral detectable range Dc defined by the right and left edges. The workpiece fabric edgeline position data Dd is represented by a distance between the right edge of the detectable range Dc and the edgeline of the workpiece fabric 70. This position data Dd is provided on a basis of the detection signal from the edge detector 54. The stitch margin data Dw represents a size of the stitching margin, and is set by the manipulation to the stitch margin setting means 28. (In FIG. 6, the stitching line is represented by characters ST). After these data Dd and Dw are read, the routine proceeds into Step S6 where the sewing needle position data Dp is computed. The result of the computation is stored in the needle position data memory 110. In accordance with the present embodiment, the position of the sewing needle 46 is derived by the workpiece fabric edgeline position data Dd, the stitching margin data Dw, detectable range Dc of the edge detector 54, and data Da representing a distance between the left edge of the detectable range Dc and a left edge of the swingable rang of the sewing needle 46. That is, provided that a left edge of the maximum swingable range X of the sewing needle 46 is regarded as a reference position, the sewing needle position data Dp is represented by the following equation:

$$Dp = Dc - Da - Dd - Dw$$

In this equation, the data Da and Dc are constant values and are provisionally stored in the memory of the ROM 94.

After the computation of the position data Dp, the routine proceeds into Step S7, where a drive signal is transmitted to the needle swing control motor 50 on a basis of the sewing needle position data Dp. Upon rotation of the needle swing control motor 50, the sewing needle 46 is shifted rightwardly from its left edge position of the maximum swingable range X by a distance represented by the needle position data Dp. That is, the sewing needle 46 is brought to an intended needle location whose position is inwardly spaced away from the edgeline of the workpiece by the intended stitching margin. Consequently, the profile sewing can be made in parallelism with the edgeline of the workpiece fabric 70.

Then, in Step S8, the workpiece fabric edgeline position data Dd read in the Step S5 is computed in the CPU 92, and in Step S9, the projector 52 is rendered ON through the output interface 108 in accordance with the result of the computation. Therefore, a proper edgeline position of the workpiece fabric 70 can be provided on the bed 10 or on the workpiece fabric 70 on the bed by the reference line or guide line as a visualized projection image which provides the proper margin set by the operator. The projected reference line 80 may be positioned by a distance corresponding to a margin length measured from a swingable center line C of the sewing needle 46. For example, in FIG. 7, if the sewing needle 46 is positioned on the swingable center C, the edgeline 70' of the workpiece 70 can be positioned coincident with the reference line 80. However, in FIG. 7, the sewing needle 46 is displaced leftwardly relative to the swingable center C, and the edgeline 70' of the workpiece fabric 70 is positioned slightly leftwardly with respect to the reference line 80. Still however, the reference line 80 can serve as a guide line for providing a proper margin.

Thus, the stitching reference line 80 can be utilized as a guide line for the operator, so that the workpiece fabric 70 can be positioned at the most suitable location on the bed 10 with reference to the stitching guide line 80 as far as the sewing needle is positioned within its swingable range.

Figure 8:
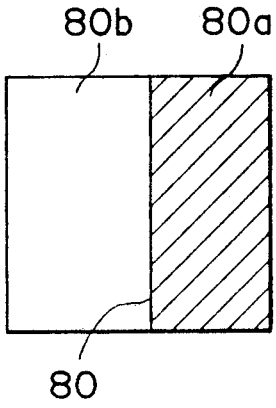

Furthermore, as shown in FIG. 8, a two dimensional projection image can be provided on the bed 10 or on the workpiece fabric. The two dimensional image is divided into two sections 80*a* and 80*b* by colors different from each other in which the stitching reference line 80 divides the image into the two sections 80*a*, 80*b*. With using the projection image, the operator can note the displacing direction of the sewing needle 47 relative to the swingable center C.

Figure 9:
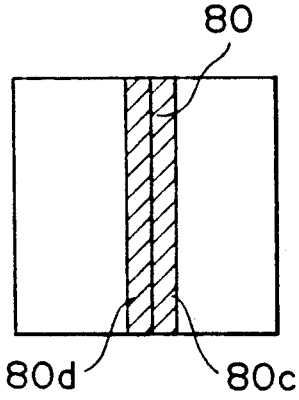

Moreover in another modification, a stitching reference has a predetermined width as shown in FIG. 9, in which a reference line 80 divides the width into halves. The width corresponds to the maximum swingable range X (FIG. 6) of the sewing needle 46. In other words, as far as the edgeline 70' of the workpiece fabric 70 is positioned on one of the sections 80*c* and 80*d*, the profile sewing can be carried out. For example, if the edgeline 70' is positioned on the section 80*c*, the operator can perform profile sewing operation with reference to the reference line 80, while assuming that the sewing needle 46 is positioned rightwardly with respect to its swingable center line C. However, if the edgeline 70' is positioned out of the sections 80*c* or 80*d*, it can be understood that the sewing needle 46 is positioned at an unwanted swinging position, or the sewing needle cannot be any more swung within the arcuate needle slot 72.

INDICATION FOR THE CORRECTION TO ACTUAL STITCHING POSITION

In the present embodiment, in addition to the visualization of the stitching reference in conformance with the edgeline of the workpiece fabric, can be displayed, by steps beginning from Step S10, the direction for correcting the displacement of the workpiece fabric if the latter is deviated from the profile stitching position. That is, in these steps shown in FIG. 5, needle location is investigated, and if the sewing needle 46 is positioned at rightmost or leftmost stroke end, (in the described embodiment, if the sewing needle 46 is positioned within 1 mm from the rightmost or leftmost stroke end), the needle position and position correcting direction are projected by the projector 52.

Figure 7:
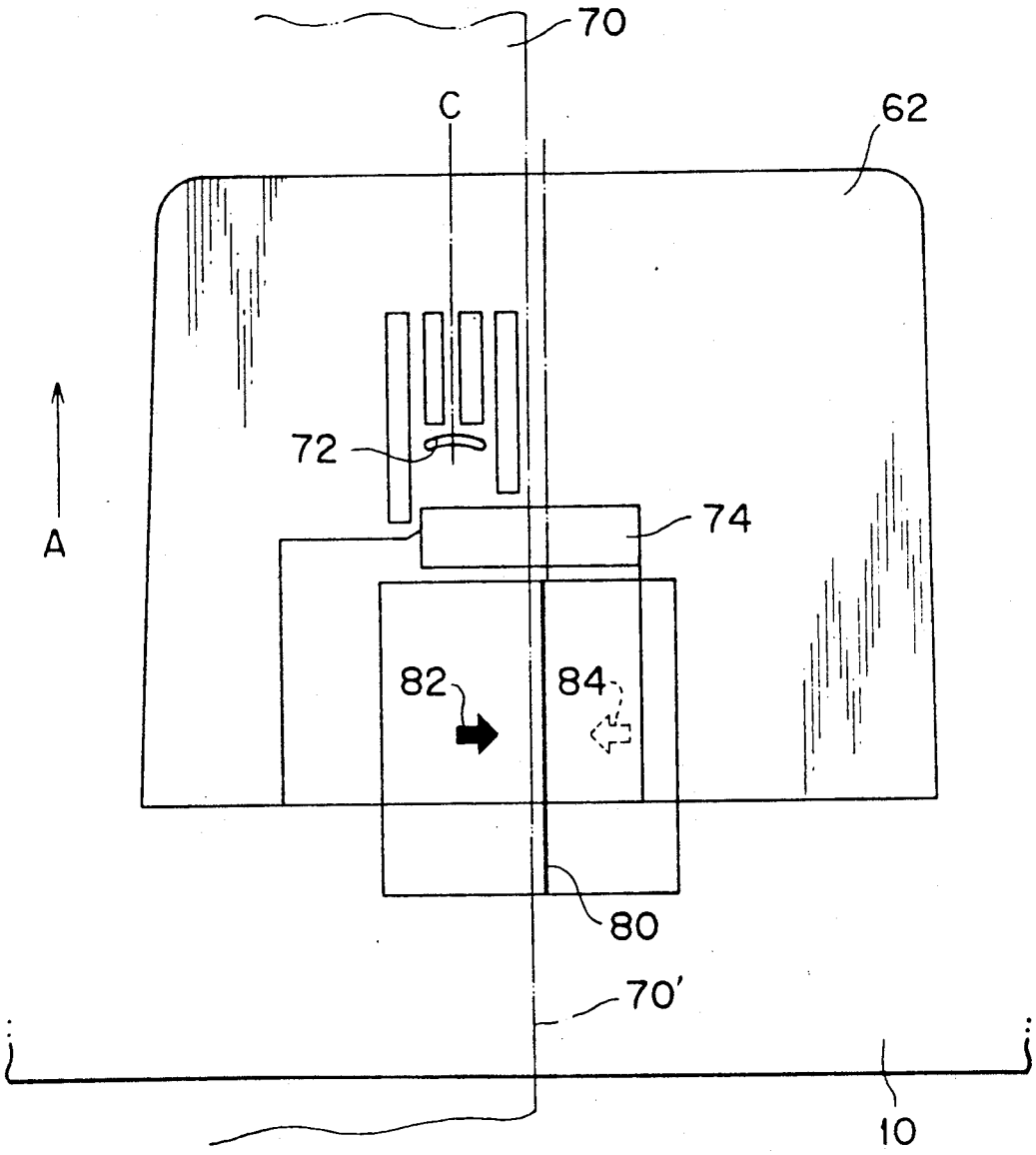
FIGS. 7 through 9 are plan views showing visualized images indicative of a stitching reference along a workpiece edgeline, the image being projected on a surface of a bed in accordance with the embodiment of this invention.

Firstly, in Step S10, determination is made as to whether or not the sewing needle 46 is positioned within 1 mm from the leftmost end of the maximum swingable range on a basis of the needle position data Dp. If it is the case, the determination falls Yes, and the routine goes into Step S11. In Step S11, the correcting direction is projected by the projector 52 as shown in FIG. 7, where an arrow image 82 directing toward the right is displayed on the bed or on the workpiece fabric. Therefore, the operator can note that the sewing needle is excessively displaced leftwardly, and the correcting direction is determined as to be rightwardly.

Incidentally, during the profile sewing, the sewing operation is temporarily stopped, and the workpiece fabric 70 is manually moved for the correction. Alternatively, the sewing speed is lowered for controlling the position of the workpiece fabric without temporary stop of the profile sewing operation. Further, prior to the profile sewing operation, by moving the fabric 70 in accordance with the arrow display 82, the sewing needle 46 can stitch the workpiece at a position approximately at the swingable center line C.

On the other hand, if the sewing needle 46 is positioned away by more than 1 mm from the leftmost stroke end, the judgment in Step S10 falls No, so that the routine proceeds into Step S12. In the Step S12, judgment is made as to whether or not the sewing needle 46 is positioned within 1 mm from the rightmost end stroke. This judgment is based on an equivalent judgment as to whether or not the sewing needle 46 is positioned within a range of 6 mm to 7 mm from the leftmost stroke end. If the judgment falls Yes, the routine goes to Step S13 where, as shown in FIG. 7, a leftwardly directing arrow image 84 is provided on the bed 10. Therefore, the operator can notify that the sewing needle 46 is excessively displaced rightwardly so that the correcting direction is revealed to be left.

Further, if the sewing needle 46 is far spaced away from the rightmost stroke end by more than 1 mm, the judgment in Step S12 falls No, so that the routine returns back to the main routine. In the latter case, the sewing needle 46 is not largely displaced, and it is unnecessary to perform positional correction. Therefore, the operator can continue the profile sewing operation.

In the above described embodiment, the profile sewing operation is made on the premise of the linearly orienting edgeline of the workpiece. However, even if a curved or arcuate edgeline is provided, a curved or arcuate stitching reference line 80 can be provided from the projector 52. This can be done by storing a data of radius of curvature or pattern data of a paper pattern into the control device, and by supplying the data to the projector 52.

Further, in the above described embodiment, the profile sewing machine provided with the fabric edgeline detector 54 is used for embodying the invention. However, the present invention is also available for a sewing machine having an automatic profiling mechanism for automatically following the sewing needle along the workpiece edgeline, or for an ordinary sewing machine having no workpiece edgeline detector. In other words, the present invention can be established by incorporating the above described memory means which stores therein data of the needle position positioned inward of the edgeline by a given distance and the projector for projecting the stitching reference or guide line in accordance with the needle position data read out from the memory. Furthermore, the present invention can also be reduced to practice by the employment of the projector 52 on the sewing machine other than the linearly stitching profile sewing machine such as a zigzag stitch sewing machine or an embroidery sewing machine in which the workpiece fabric is abruptly moved on a horizontal plane while the sewing needle is vertically reciprocated.

What is claimed is:

1. A sewing machine including a bed (10), a sewing needle (46) vertically reciprocable for stitching to a workpiece fabric (70) at a position inward from an edgeline (70') and in parallelism therewith to provide a margin, a sewing needle swinging mechanism (FIG. 2) for swinging the sewing needle within a maximum swingable range (X) in a direction across a feeding direction (A) of the workpiece fabric, the swingable range defining a swingable center (C) between one and another swinging end stroke positions, sewing margin setting means (28) for setting the margin, and detection means (54) for detecting the edgeline of the workpiece fabric; and the improvement comprising:

(a) control means connected to the sewing needle swinging mechanism, the sewing margin setting means (28) and the detection means (54), the control means comprising:

means for computing needle position data (Dp) on a basis of first data (Dd) indicative of the edgeline position sent from the detector (54) and second data (Dw) provided by the sewing margin setting means (28); and memory means (96, 110) which stores therein the needle position data (Dp), the needle position data (Dp) being transmitted to the sewing needle swinging mechanism so as to move the sewing needle (46) to a position inwardly spaced away from the edgeline to provide the margin; and (b) image forming means (52) connected to the control means for providing a visualized image of a stitching reference line (80) on one of a surface of the bed and the workpiece fabric on the bed in accordance with the needle position data (Dp), the stitching reference line serving as a guide line along which the edgeline is placed.

2. The sewing machine as claimed in claim 1, wherein the image forming means comprises a projector (52) which provides a line projection image in response to the needle position data (Dp).

3. The sewing machine as claimed in claim 2, wherein the projector (52) comprises a light source (66), a liquid crystal panel (68) connected to the memory means (96), and a focusing lens (76) for focussing light passing through the liquid crystal panel onto one of the bed (10) and the workpiece fabric on the bed (10).

4. The sewing machine as claimed in claim 3, wherein the projector (52) is mounted on the detector (54).

5. The sewing machine as claimed in claim 1, wherein the image forming means comprises a projector which provides a first color section (80*a*) and a second color section (80*b*), a boundary between the first and the second color sections being a central stitching reference line (80) when the sewing needle (46) is positioned on the swingable center (C).

6. The sewing machine as claimed in claim 1, wherein the image forming means comprises a projector which provides a first image section (80*c*) having a first width and a second image section (80*d*) having a second width, a boundary between the first and the second image sections being central stitching reference line (80) when the sewing needle (46) is positioned on the swingable center (C), and the first width corresponding to a first distance between one stroke end position and the swingable center, and the second width corresponding to a second distance between the other stroke end position and the swingable center.

7. The sewing machine as claimed in claim 1, further comprising means for displaying a direction (82, 84) for correcting a position of the workpiece fabric if the edgeline of the workpiece fabric is displaced from the stitch reference line (80), the displayed direction being provided at a position adjacent the stitching reference line (80).

8. The sewing machine as claimed in claim 7, wherein the direction displaying means comprises:

first judging means (S10) for making judgment as to whether or not the sewing needle is positioned near one stroke end portion of the swingable range (X);

second judging means for making judgment as to whether or not the sewing needle is positioned near the other stroke end portion of the swingable range (X); and a direction image forming means for providing a first direction image (82) if a position of the sewing needle is positioned near the one stroke end portion of the swingable range and for providing a second direction image (84) opposite the first direction image if a position of the sewing needle is positioned near the other stroke end portion.

* * * * *